United States Patent [19]

Shaw et al.

[11] Patent Number: 4,514,280

[45] Date of Patent: Apr. 30, 1985

[54] DEWAXING WAXY OIL BY DILUTION CHILLING EMPLOYING STATIC MIXING MEANS

[75] Inventors: David H. Shaw, Sarnia, Canada; Ralph R. Hall, Morristown, N.J.

[73] Assignee: Exxon Research and Engineering Co., Florham Park, N.J.

[21] Appl. No.: 963,577

[22] Filed: Nov. 24, 1978

Related U.S. Application Data

[63] Continuation of Ser. No. 582,652, Jun. 2, 1975, abandoned.

[51] Int. Cl.[3] ..... C10G 73/06

[52] U.S. Cl. ..... 208/33

[58] Field of Search ..... 208/33

[56] References Cited

U.S. PATENT DOCUMENTS

| | | | |
|---|---|---|---|
| 2,287,966 | 6/1942 | Brandt | 208/33 |
| 2,612,465 | 9/1952 | Kiersted et al. | 208/33 |
| 3,286,992 | 11/1966 | Armeniades et al. | 138/42 |
| 3,458,431 | 7/1969 | Nixon | 208/33 |
| 3,642,609 | 2/1972 | Mayer et al. | 208/33 |
| 3,850,740 | 11/1974 | Gudelis et al. | 208/33 |
| 4,088,565 | 5/1978 | Watts et al. | 208/33 |

OTHER PUBLICATIONS

Chen et al., "Chemical Engineering", Mar. 19, 1973, pp. 105 to 111.

*Primary Examiner*—Curtis R. Davis
*Attorney, Agent, or Firm*—Edward M. Corcoran

[57] ABSTRACT

An improved process for the solvent dewaxing of petroleum oil stocks. Wax-containing oil is chilled in an elongated chilling zone by introducing cold dewaxing solvent into said zone, at a plurality of points along same, said chilling zone containing or having associated with it a plurality of static means for mixing the solvent and wax-containing oil under conditions of plug flow radial mixing, thereby avoiding shock chilling without the need for the intense agitation and/or dynamic agitators normally required for such processes.

2 Claims, 2 Drawing Figures

DEWAXING WAXY OIL BY DILUTION CHILLING EMPLOYING STATIC MIXING MEANS

This is a continuation of application Ser. No. 582,652, filed June 2, 1975, abandoned.

BACKGROUND OF THE INVENTION

1. Field of the Invention

This invention relates to a process for solvent dewaxing waxy oils. More particularly, this invention relates to a process wherein waxy oil is introduced into a cooling zone and the wax is precipitated from the oil by the incremental addition of prechilled dewaxing solvent along the length or height of the cooling zone. Still more particularly, this invention relates to a process wherein the mixing of the chilled dewaxing solvent and wax-containing oil in the cooling zone is accomplished by static mixing means under conditions of plug flow radial mixing, as opposed to the heretofore employed dynamic mechanical agitators such as impellers, rotating vanes, etc.

2. Description of the Prior Art

It is well known in the prior art that wax-containing petroleum oil stocks can be dewaxed by shock chilling with a cold solvent. It is also known in the prior art that shock chilling, in itself, results in a low filtration rate of the dewaxed oil from a wax/oil mixture. It is now well known that the shock chilling effect can be overcome by introducing the waxy oil or wax/oil mixture into a cooling zone and incrementally introducing a dewaxing solvent into said zone, along a plurality of points or stages therein, while maintaining a high degree of agitation so as to effect substantially instantaneous mixing of solvent and wax/oil mixture as they progress through the chilling zone. This latter concept is shown in U.S. Pat. No. 3,773,650 and shall hereafter be referred to as Dilution Chilling.

A number of improvements have been made to the basic concept of Dilution Chilling. U.S. Pat. No. 3,642,609 shows that in a vertically staged cooling tower, the velocity of the solvent at the injection points should be at least 5–30 times that of the peripheral velocity of the mixer blades. This results in greater filtration rates and dewaxed oil yields than could be obtained without the relatively high velocity solvent injection. U.S. Pat. No. 3,681,230 discloses another improvement in Dilution Chilling wherein the waxy oil and solvent are miscible until the temperature approaches the wax-oil separation temperature, which generally occurs near the last stage of the cooling zone. This results in superior dewaxed oil yields and filter rates when the waxy oil stock being fed to the tower is relatively high in viscosity and molecular weight. However, in all of these processes there must be a plurality of intensely agitated stages so as to effect substantially instantaneous mixing of the waxy oil or wax/oil mixture and solvent.

Agitators normally employed for this purpose are mechanical agitators such as propellers, paddles and disc turbines with disc turbine impellers being the most preferred type of agitator. For practical reasons, this necessitates the use of large, staged towers employing a single impeller shaft centrally mounted within the tower. The design of such towers is complicated, difficult to fabricate and install and can be prone to operating difficulties if not done properly. These towers are relatively expensive. Further, there must be a means for sealing the dewaxing solvent in the tower around said shaft and at the same time maintain a strong bearing support for the shaft.

It would be a significant improvement to the art if one could do away with the need for these dynamic mechanical agitators.

SUMMARY OF THE INVENTION

A process has now been found for dewaxing a wax-containing oil that has the advantages of Dilution Chilling with few, if any, of its disadvantages resulting from the dynamic mechanical mixing equipment heretofore required. This process for dewaxing a waxy or wax-containing oil comprises:

(1) introducing a stream of waxy oil into an elongated cooling zone containing static plug flow radial mixing means having a plurality of stationary elements longitudinally disposed within said means to successively divide said stream and to at least partially recombine the divided streams; and (2) introducing cold dewaxing solvent into said cooling zone at a plurality of points along said zone in order to progressively mix said solvent and said waxy oil by said static mixing means under conditions of plug flow radial mixing as said waxy oil and solvent progress through said cooling zone, thereby precipitating a substantial portion of wax from said waxy oil.

It has further been discovered that the mixing in the static mixing means can even be under laminar flow conditions without incurring the well known shock chilling effect, which results in relatively small wax crystals with resulting low filtration rates of the dewaxed oil from the wax slurry. Alternatively, the mixing can occur under turbulent flow conditions. Static mixing means may be employed to mix the solvent and wax/oil mixture after each point of solvent injection, or the static mixing means may itself comprise at least a portion of the cooling zone, with cold solvent injected into it at a plurality of points along said zone. Alternatively, it may be advantageous not to employ static mixing means at or after every point of solvent injection into the cooling zone.

This process eliminates the need for the intense agitation and dynamic mechanical mixing devices heretofore required. Further, employing static mixing means also eliminates the need for having a relatively large, staged tower, although such a tower can be adapted for use with static mixing means. Instead of a tower, one can employ one or more vertical or horizontal elongated cooling zones, with static mixing means either associated with said zones or employed as an integral part of the cooling zones. Still further, static mixing means may be employed in conjunction with more conventional dewaxing operations, such as scraped surface dewaxing, autorefrigerative dewaxing, etc.

By static plug flow radial mixing means is meant mixing means employing no moving parts, but which contain therein means or elements for successively dividing or splitting up a stream of fluid into partial streams and then at least partially recombining the divided streams before they are divided again under conditions of plug flow radial mixing. While various types of static plug flow radial mixers can be employed, the principle involved in each mixer is basically the same. An incoming flow of unblended or unmixed material is split into a host of substreams which are diverted in various directions, perhaps rotated and are then brought back together again, at least partially, before being split up once more and so on. The number of substreams increases rapidly as the material passes through the mixer, so that on exiting from the mixer, the material is a fairly homogeneous mixture. In each case, the generation of these substreams is due to a series of "elements" and it is the detailed design of these elements which differentiate one type of mixer from the next. The mixing action of the mixers can be more or less independent of flow rate and the flow therethrough can be either laminar or turbulent.

One type of static plug flow radial mixing device which has been found useful in this invention is a "Static Mixer" which may be obtained commercially from the Kenics Corporation of Danvers, Mass. This type of mixer is a plug flow radial mixer and consists of a series of twisted or curved elements enclosed within a tube and is described in U.S. Pat. No. 3,286,992, the disclosures of which are incorporated herein by reference. Each element is a length of twisted sheet metal or plastic sheet cut in 180° twisted sections.

A better understanding of this device and plug flow radial mixing can be obtained by referring to FIG. 1 which is a partial sectional view of a portion of a "Static plug flow radial Mixer" static mixing device comprising tube 1 which encloses mixing elements 2 and 3. As shown in FIG. 1, the right and left-hand twists can be juxtaposed and the trailing edge of a mixing element may be at right angles to the leading edge of the next mixing element. The initial fluid stream consisting, for example, of two or more unmixed components strikes the upstream edge of mixing element 2, which splits it into two partial streams, preferably but not necessarily equal, each stream containing portions of the unmixed components. The twisting configuration of the mixing element imparts a double rotational motion on these partial streams while they move forward through the tube 1. As the streams rotate helically in order to follow the configuration of the element, the velocity of the fluid near the wall of the tube is greater than that of the fluid near the tube center. This results in an eddy current motion within each partial stream which causes some mixing of the components. As the fluid meets the upstream edge of the mixing element 3, it is forced to split again along a new surface creating two new partial streams, each of them now combining portions of both previous partial streams. The components of these streams are again forced to mix by the aforementioned eddying motion, while the new streams rotate helically following the configuration of element 3. This process is repeated with each element as the fluid travels along tube 1 until the original multicomponent stream has been split and recombined along new surfaces by a number of elements sufficient for thorough mixing of the original unmixed stream. This is called flow division and results in an exponential increase in stratification defined by $S=2^n$ where n is the number of elements. It is possible, therefore, for 20 elements to produce over one million splits or substreams or, for a two-component system, over two million layers.

In this type of mixing, which is plug flow radial mixing, there can exist flow division, flow inversion, flow reversal and back mixing, all occurring in a single pass through the mixer. In flow inversion, particles migrate from the wall of the mixing means to the center of the stream and back to the wall due to transverse displacement. Flow reversal is caused by the opposite pitch rotation of successive elements reversing the bulk flow at each element junction. In addition, a counter rotation of constituents with respect to element direction occurs in each element which further enhances mixing and contacting. Back mixing occurs as a result of the constant change in flow profile of bulk fluid passing through a geometric pattern.

Other well known static plug flow radial mixers currently commercially available are the Ross ISG (Interfacial Surface Generator) and the Sulzer mixer. As with the Kenics Static Mixer, each of these mixers comprises an elongated housing or tube containing static elements for successively splitting up a stream into partial streams and then recombining the partial streams. It is understood, of course, that the embodiment contained herein is not limited to the specific examples given, but applies to any device which employs static elements or means for splitting a fluid stream into partial streams and then at least partially recombining said partial streams causing mixing thereof.

Although plug flow radial mixing mixing has heretofore been employed in the petroleum industry in various blending operations such as blending reactor feeds, distillate feed stocks and additives (Process Engineering, April 1973, page 78), it has not been heretofore suggested that plug flow radial mixing mixing means could be used in Dilution Chilling operations to mix the waxy oil and solvent and, at the same time, avoid the shock chilling effect without requiring the intense agitation and attendant dynamic mechanical mixers heretofore required. Dilution Chilling can even be achieved by employing static mixing means at laminar flow rates, thereby greatly reducing shear of the wax crystals in the wax/oil/solvent slurry. The use of static mixing means can substantially reduce the complexity and cost of Dilution Chilling plant facilities and operations currently employed in the industry.

Any waxy petroleum oil stock or distillate fraction thereof may be dewaxed with the process of this invention. In general, these oil stocks or distillate fractions will have a boiling range within the broad range of about 500° F. to about 1300° F. The preferred oil stocks are the lubricating oil and specialty oil fractions boiling within the range of 550° F. and 1200° F. These fractions may come from any source, such as the paraffinic crudes obtained from Aramco, Kuwait, the Panhandle, North Louisiana, Tia Juana, etc., naphthenic crudes such as Coastal Crudes, etc., as well as the relatively heavy feed stocks such as bright stocks having a boiling range of 1050+° F. and synthetic feed stocks derived from Athabasca tar sands, etc.

Any solvent useful for dewaxing waxy petroleum oils may be used in the process of this invention. Representative examples of such solvents are (a) the aliphatic ketones having from 3–6 carbon atoms, such as acetone, methyl ethyl ketone (MEK) and methyl isobutyl ketone (MIBK) and (b) the low molecular weight autorefrigerant hydrocarbons, such as ethane, propane, butane and propylene, as well as mixtures of the foregoing and mixtures of the aforesaid ketones and/or hydrocarbons with aromatic compounds, such as benzene, xylene and toluene. In addition, halogenated, low molecular weight hydrocarbons, such as $C_2$–C4 chlorinated hydrocarbons (e.g., dichloromethane, dichloroethane, methylene chloride) and mixtures thereof may be used as solvents either alone or in admixture with any of the forementioned solvents. Another solvent that may be used in admixture with any of the other solvents is N-methyl-2-pyrrolidone.

Specific examples of suitable solvents are mixtures of MEK and MIBK, MEK and toluene, dichloromethane and dichloroethane, propylene and acetone. Preferred solvents are ketones. A particularly preferred solvent is a mixture of MEK and MIBK.

The solvent is prechilled to a temperature sufficient to permit cooling of the waxy oil to the dewaxing temperature. The exact temperature of the solvent employed will depend upon the amount of oil to be cooled and the amount of solvent to be added to the oil. In many cases, the solvent is prechilled down to at least 0° F. before being introduced into the cooling zone. The prechilled solvent is added incrementally along the cooling zone so as to maintain an average chilling rate at or below about 10° F. per minute and preferably between about 1 to about 5° F. per minute. In general, the amount of solvent added will be sufficient to provide a liquid/solid weight ratio between the range of 5:1 and 20:1 at the dewaxing temperature and a solvent/oil volume ratio between 1.5:1 and 5:1.

Where the waxy petroleum oil feed stock is to be prediluted with solvent prior to its introduction into the cooling zone, the predilution solvent may be selected from any of the dewaxing solvents known in the prior art including those solvents outlined above.

DETAILED DESCRIPTION

Figure 1:
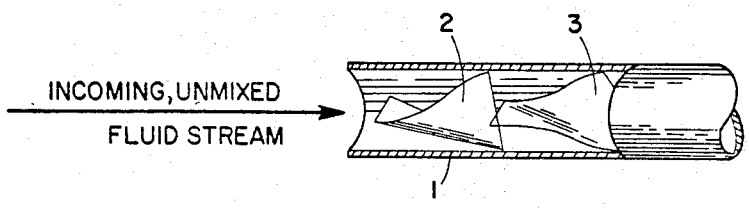
FIG. 1 is a partial sectional view of a type of static mixer useful herein.

FIG. 1 has been substantially described under SUMMARY OF THE INVENTION, supra.

Figure 2:
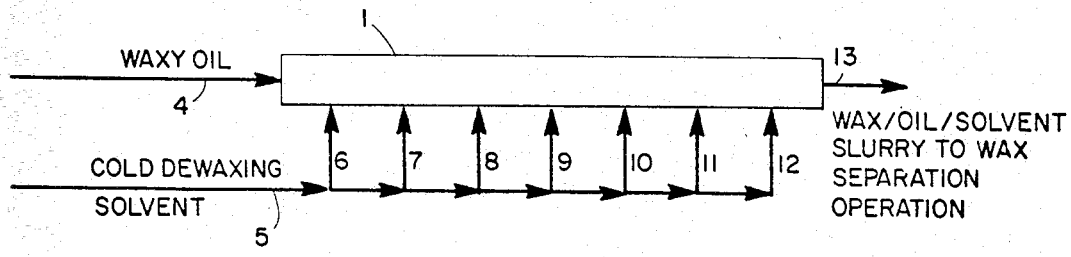
FIG. 2 is a flow diagram of a preferred embodiment of the invention.

Referring to FIG. 2, a waxy petroleum oil stock is introduced into an elongated cooling zone (e.g., the aforedescribed static mixer of FIG. 1) via line 4. Cooling zone 1 contains static mixing means therein for flow radial mixing. The waxy oil may or may not have been prediluted with a solvent. Although not shown, heating means may be provided for the waxy petroleum oil stock prior to its introduction into the cooling zone in order to ensure that the feed temperature is above the cloud point of the oil or the depressed cloud point of the oil/solvent mixture prior to introducing same into the cooling zone. Cold dewaxing solvent is introduced into manifold 5 which comprises a series of paths 6–12 for providing solvent to the multiple solvent injection points of cooling zone 1. The rate of flow through each inlet is regulated by flow control means (not shown). The rate of solvent flow is regulated so as to maintain the desired temperature gradient along the length of cooling zone 1. The first portion or increment of the cold dewaxing solvent may enter the cooling zone just prior to the first static mixing means contained therein, wherein it is contacted with the wax-containing petroleum oil. The waxy oil and solvent progress through the cooling zone to the first series of static mixing elements (or interfacial surface generators) whereby they are mixed under conditions of plug flow radial mixing and under either turbulent or laminar flow conditions, i.e., at modified Reynolds Numbers of from 2 to 150,000. Each additional increment of prechilled solvent is introduced into the cooling zone at a point along the length of said zone so as to maintain a controlled cooling rate and at the same time to provide the desired degree of dilution. Downstream of each solvent injection point in the cooling zone is at least one static mixing means containing more than one static mixing element in order to provide plug flow radial mixing of the wax/oil/solvent mixture and the new increment of cold solvent as they progress through the cooling zone.

It should be noted that any number of solvent injection points and static mixing means or units may be employed; however, it is desirable that at least six points of solvent injection be used, each point of solvent injection being followed by at least one static mixing means for plug flow radial mixing. It will be apparent to those skilled in the art that the exact solvent temperature employed will depend on the amount of oil to be cooled, the composition of the solvent, the amount of solvent to be added to the oil, i.e., the degree of oil dilution which is sought during the filtration step and the nature or type of waxy petroleum feed stock that is used.

The cooling of the waxy oil feed stock continues to a temperature substantially below its cloud point, thereby precipitating at least a portion of the wax therefrom and forming a wax/oil/solvent slurry. The slurry passes from the final mixing zone or the last stage of the cooling zone through line 13 to means for separating the wax from the slurry. Any suitable separation means, such as filtration or centrifugation, may be employed. Additionally, there may be either substantially bulk miscibility or immiscibility between the solvent and the oil at one or more points within the cooling zone. Before going to the separation means, additional solvent may be added to the slurry and/or supplementary chilling by scraped surface chilling, autorefrigeration, etc., may be employed to further cool said slurry.

The cooling zone of the present invention is preferably operated at a pressure sufficient to prevent flashing of the solvent. Atmospheric pressure is sufficient when ketones and aromatics are employed as solvents; however, superatmospheric pressures are required when low molecular weight hydrocarbons such as propylene or propylene/acetone and other related autorefrigerative solvents and autorefrigerative solvent/ketone solvent systems are used. A process combining both vaporization of the solvent to provide in situ refrigeration and direct cooling from cold dewaxing solvent is disclosed in U.S. Pat. No. 3,658,688, granted on Apr. 25, 1972, the disclosures of which are incorporated herein by reference.

The recovered lube oil products may, if so desired, be subjected to various finishing operations such as clay contacting, hydrofinishing, acid treatment and the like. In addition, various inhibitors and other additive ingredients may be added in order to provide various finished lube oil products.

PREFERRED EMBODIMENT

The invention will be more apparent from the working examples set forth below.

Laboratory experiments were performed employing a Static Mixer unit purchased from the Kenics Corporation, which is a plug flow radial mixing device. This unit was 21½" long with an I.D. of 0.622" and contained 21 "elements." The Static Mixer unit was incorporated into a recycle loop around a single stage Dilution Chilling laboratory batch unit which, while not completely duplicating continuous multistage operation, has been found to give results approximately equivalent to those obtained with continuous, commercial multistage operations. The unit contained a flat bladed impeller and a solvent injection tube. The recycle loop contained a Moyno pump to provide flow of the wax/oil/solvent slurry through the static mixing device with little or no adverse effect to said slurry. It is well known in the art that Moyno pumps permit pumping of crystal slurries with a minimum of shearing agitation and attendant deleterious effect on the crystal structure of the wax crystals as would occur with more conventional pumps.

Experiments were conducted by filling the unit with the waxy oil to be chilled at just above its cloud point. After the unit was filled with the waxy oil, the impeller and/or Moyno pump were started along with the simultaneous injection of chilled solvent into the waxy oil at either the impeller tip in the mixing section or just upstream of the Static Mixer in the recycle loop, depending upon the variables to be studied.

Following the addition of the desired volume of cold dilution solvent, the slurry from the unit was then scrape surface chilled at a rate of 2°-3° F. per minute until the filter temperature was reached. The filter rate and the waxy oil yield were determined by filtration in the well known manner.

The dewaxing solvent used in these experiments was a 45/55 LV% (liquid volume) mixture of MEK/MIBK precooled to −20° F. The waxy oil feed used in the experiments was a phenol raffinate of a vacuum distillate cut from a West Canadian crude (paraffinic), with a boiling range of approximately 650°-1170° F., an API gravity of 29°, an initial pour point of about 130° F., an initial cloud point of 128° F., a dry wax content of about 22% to produce a dewaxed oil having a 25° F. pour point and a viscosity of 575 SUS at 100° F., and 60 SUS at 210° F., which corresponds to a VI of about 90.

EXAMPLE 1

The laboratory unit was first run by injecting the cold solvent at the impeller tip with the recycle loop closed off, thus simulating conventional Dilution Chilling as heretofore described. The impeller was run at a speed of 1050 rpm which corresponded to a maximum peripheral Reynolds Number of from 719 at the beginning of the experiment to over 8000 at the end. This resulted in predominantly turbulent conditions at the impeller tip for the mixing of the cold solvent and waxy oil. The experiment was then repeated, but with the following changes:

(a) the recycle loop was operated to give a flow rate of about ½ USG/minute through the Static Mixer, corresponding to theoretical Reynolds Numbers of from about 16 to 194; and (b) cold solvent was added just upstream of the Static Mixer instead of at the tip of the impeller, thereby insuring that the solvent and oil were mixed in the static mixing unit.

The results of the experiments are given in Table I and show that plug flow radial mixing at laminar flow rates gave about the same feed filter rate as the conventional Dilution Chilling using the more severe dynamic mechanical agitation and turbulent flow heretofore required.

TABLE I

COMPARISON OF STATIC AND IMPELLER MIXING IN DEWAXING OPERATIONS

| | Static Mixer | Dynamic Impeller[a] |
|---|---|---|
| Solvent feed to filter, wt/wt | 2.76 | 2.80 |
| Solvent wash/feed, wt/wt. | 0.70 | 0.88 |
| Dewaxed oil yield, wt. % on feed | 69 | 75 |

TABLE I-continued

COMPARISON OF STATIC AND IMPELLER MIXING IN DEWAXING OPERATIONS

| | Static Mixer | Dynamic Impeller[a] |
|---|---|---|
| Feed filter rate, USG/ft$^2$-hr | 6.4 | 6.5 |

Note:
[a]no recycle.

EXAMPLE 2

In another experiment, the Static Mixer unit was replaced with an empty (unbaffled) tube of the same length and inside diameter. With the impeller rpm and recycle flow rate the same as for the case where the Static Mixer was employed in Example 1, cold solvent was again injected into the recycle loop just at the upstream side of the unbaffled tube. Severe wax deposition occurred in the unit and the experiment was considered a failure as far as dewaxing was concerned.

Another run was made with the same impeller speed and the same flow rate through the unbaffled tube, but with the solvent injected at the periphery of the impeller. As the data in Table 2 show, the effect of operating the conventional Dilution Chilling laboratory batch unit with recycle was a decrease in the feed filter rate in spite of the fact that considerably more solvent was used.

Finally, a third run was made with the unbaffled tube in the recycle loop at the same volumetric flow rate as before, but with the stage agitator running at the negligible speed of 90 rpm. As indicated in Table 2, no data were available from this run because the apparatus clogged up with wax.

TABLE 2

EFFECT OF OPERATING LABORATORY BATCH UNIT (IMPELLER MIXING) WITH BLANK RECYCLE LOOP

| | Run No. 1 | Run No. 2 | Run No. 3 |
|---|---|---|---|
| Point of solvent addition[a] | R | I | R |
| $N_{Re}$ at impeller tip | 719-8,000 | 719-8,000 | 62-723 |
| Flow rate through recycle loop, USG/min. | ½ | ½ | ½ |
| Solv./feed to filter, wt./wt. | unit plugged up with wax | 3.83 | unit plugged up with wax |
| Solv. wash/feed, wt./wt. | | 0.57 | |
| Dewaxed oil yield, wt. % on feed | | 67.5 | |
| Feed filter rate, USG/ft$^2$-hr. | | 5.8 | |

Note:
[a]R — Just upstream of unbaffled tube in recycle loop.
I — at impeller tip.

Comparing the results of this example with the results obtained in Example 1, both illustrates and proves the beneficial effect of static plug flow radial mixing in Dilution Chilling dewaxing processes.

EXAMPLE 3

Another experiment was conducted in order to determine the effect of flow rate and corresponding Reynolds Number through the static mixing unit, while at the same time maintaining a substantially negligible stage impeller speed of 90 rpm. Cold (−20° F.) dewaxing solvent (45/55LV% MEK/MIBK) was added to the waxy oil just upstream of the Static Mixer.

The results are shown in Table 3 and indicate that the benefits of Dilution Chilling dewaxing can be achieved with static plug flow radial mixing means at turbulent flow rates, in addition to laminar flow rates.

TABLE 3

INFLUENCE OF REYNOLDS NUMBER IN STATIC MIXER ON DEWAXING OPERATIONS[a]

| | Run No. | | |
|---|---|---|---|
| | 1 | 2 | 3 |
| $N_{Re}$ in Static Mixer | 16–194 | 82–970 | 160–1940 |
| Flow rate, USG/min. | 0.5 | 2.3 | 4.6 |
| Solv./feed to filter, wt./wt. | 2.81 | 2.97 | 3.00 |
| Solv. wash/feed, wt./wt. | 0.72 | 0.69 | 0.46 |
| Dewaxed oil yield, wt. % on feed | 62.8 | 65.0 | 58.0 |
| Feed filter rate, USG/ft.$^2$-hr. | 5.1 | 5.6 | 6.8 |

Note:
[a]Solvent addition in recycle loop just upstream of Static Mixer.

What is claimed is:

1. In a continuous solvent dewaxing process for separating solid wax from waxy petroleum distillate oil stock, wherein said waxy oil stock, heated for dissolving all wax therein, is treated with dewaxing solvent in a volume ratio of solvent to oil of about 1.5:1 to 5:1, wherein the oil/solvent mixture is cooled at a rate below about 10° F./min. to a temperature for forming a mixture of wax crystals in oil-solvent solution, wherein said wax/oil/solvent mixture is separated, in a solid-liquid separation zone, into a dewaxed oil-solvent solution and wax; the improvement which comprises:

(a) heating a continuously flowing mixture of waxy oil stock and aromatic hydrocarbon dewaxing solvent to a temperature above the melting point of solid wax for forming a waxy oil/aromatic solvent solution;

(b) cooling said heated waxy oil/aromatic solvent solution, at a rate below about 10° F./min. to a dewaxing temperature for crystallizing wax and forming a wax/oil/aromatic solvent mixture;

(c) mixing said wax/oil/aromatic solvent mixture with cold ketone dewaxing solvent, under conditions of plug flow radial mixing, to form a second wax/oil/solvent mixture; and (d) flowing said second wax/oil/solvent mixture, at said dewaxing temperature, to said solid-liquid separation.

2. The process of claim 1 wherein said aromatic solvent is toluene, and wherein said waxy oil/aromatic solvent mixture is heated to a temperature sufficient for melting said solid wax.

* * * * *